US009841254B2

(12) United States Patent
Moore

(10) Patent No.: US 9,841,254 B2
(45) **Date of Patent: *Dec. 12, 2017**

(54) FRONT-GRIP LIGHTING DEVICE

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/130,744

(22) Filed: Apr. 15, 2016

(65) Prior Publication Data

US 2016/0245617 A1 Aug. 25, 2016

Related U.S. Application Data

(63) Continuation of application No. 14/793,016, filed on Jul. 7, 2015, now Pat. No. 9,341,440, which is a continuation of application No. 14/182,140, filed on Feb. 17, 2014, now Pat. No. 9,182,194.

(51) Int. Cl.

| | |
|---|---|
| ***F41G 1/35*** | (2006.01) |
| ***F41C 23/16*** | (2006.01) |
| ***F41G 11/00*** | (2006.01) |
| ***F41C 23/22*** | (2006.01) |

(52) U.S. Cl.

CPC ..... *F41C 23/16* (2013.01); *F41C 23/22* (2013.01); *F41G 1/35* (2013.01); *F41G 11/003* (2013.01)

(58) Field of Classification Search

CPC ..... F41G 1/35; F41G 11/003; F41C 27/00; F41C 23/16; H01H 27/10

USPC ..... 42/72, 71.01, 84, 85, 90, 114, 115, 117, 42/146; 200/43.09

See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,904,888 | A | 9/1959 | Niesp |
| 3,104,478 | A | 9/1963 | Strauss |
| 3,112,567 | A | 12/1963 | Flanagan |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

EPO; Office Action dated Oct. 5, 2011 in Serial No. 09169459.

(Continued)

*Primary Examiner* — Michael David

(74) *Attorney, Agent, or Firm* — Snell & Wilmer LLP

(57) ABSTRACT

A fore grip for a firearm houses a light source and power source. The light source is preferably a laser and the power source is preferably one or more batteries. A first switch is connected to a PCB and can be moved to respective positions that correspond to each of various operating conditions, such as continuously on, continuously off, and on when a second switch is activated.

20 Claims, 3 Drawing Sheets

(56) References Cited

U.S. PATENT DOCUMENTS

| | | | |
|---|---|---|---|
| 3,192,915 | A | 7/1965 | Norris et al. |
| 3,284,905 | A | 11/1966 | Simmons |
| 3,510,965 | A | 5/1970 | Rhea |
| 3,526,972 | A | 9/1970 | Sumpf |
| 3,573,868 | A | 4/1971 | Giannetti |
| 3,633,285 | A | 1/1972 | Sensney |
| 3,641,676 | A | 2/1972 | Knutsen et al. |
| 3,645,635 | A | 2/1972 | Steck |
| 3,748,751 | A | 7/1973 | Breglia |
| 3,801,205 | A | 4/1974 | Eggenschwyler |
| 3,813,795 | A | 6/1974 | Marshall |
| 3,914,873 | A | 10/1975 | Elliott, Jr. et al. |
| 3,948,522 | A | 4/1976 | Fixler |
| 3,992,783 | A | 11/1976 | Dunlap et al. |
| 3,995,376 | A | 12/1976 | Kimble et al. |
| 4,026,054 | A | 5/1977 | Snyder |
| 4,048,489 | A | 9/1977 | Giannetti |
| 4,063,368 | A | 12/1977 | McFarland |
| 4,079,534 | A | 3/1978 | Snyder |
| 4,102,059 | A | 7/1978 | Kimble et al. |
| 4,144,505 | A | 3/1979 | Angelbeck et al. |
| 4,146,329 | A | 3/1979 | King et al. |
| 4,148,245 | A | 4/1979 | Steffanus et al. |
| 4,156,981 | A | 6/1979 | Lusk |
| 4,168,588 | A | 9/1979 | Snyder |
| 4,220,983 | A | 9/1980 | Schroeder |
| 4,222,564 | A | 9/1980 | Allen |
| 4,229,103 | A | 10/1980 | Hipp |
| 4,232,867 | A | 11/1980 | Tate |
| 4,233,770 | A | 11/1980 | de Filippis et al. |
| 4,234,911 | A | 11/1980 | Faith |
| 4,295,289 | A | 10/1981 | Snyder |
| 4,305,091 | A | 12/1981 | Cooper |
| 4,348,828 | A | 9/1982 | Snyder |
| 4,352,665 | A | 10/1982 | Kimble et al. |
| 4,452,458 | A | 6/1984 | Timander |
| 4,481,561 | A | 11/1984 | Lanning |
| 4,487,583 | A | 12/1984 | Brucker |
| 4,488,369 | A | 12/1984 | Van Note |
| 4,541,191 | A | 9/1985 | Morris et al. |
| 4,567,810 | A | 2/1986 | Preston |
| 4,662,845 | A | 5/1987 | Gallaher |
| 4,713,889 | A | 12/1987 | Santiago |
| 4,763,431 | A | 8/1988 | Allan et al. |
| 4,825,258 | A | 4/1989 | Whitson |
| 4,830,617 | A | 5/1989 | Hancox et al. |
| 4,876,816 | A | 10/1989 | Triplett |
| 4,878,307 | A | 11/1989 | Singletary |
| 4,891,476 | A | 1/1990 | Nation et al. |
| 4,934,086 | A | 6/1990 | Houde-Walter |
| 4,939,320 | A | 7/1990 | Graulty |
| 4,939,863 | A | 7/1990 | Alexander et al. |
| 4,945,667 | A | 8/1990 | Rogalski et al. |
| 4,953,316 | A | 9/1990 | Litton et al. |
| 4,967,642 | A | 11/1990 | Mihaita |
| 5,001,836 | A | 3/1991 | Cameron et al. |
| 5,033,219 | A | 7/1991 | Johnson et al. |
| 5,048,211 | A | 9/1991 | Hepp |
| 5,048,215 | A | 9/1991 | Davis |
| 5,052,138 | A | 10/1991 | Crain |
| 5,090,805 | A | 2/1992 | Stawarz |
| 5,177,309 | A | 1/1993 | Willoughby et al. |
| 5,178,265 | A | 1/1993 | Sepke |
| 5,179,124 | A | 1/1993 | Schoenwald et al. |
| 5,179,235 | A | 1/1993 | Toole |
| 5,208,826 | A | 5/1993 | Kelly |
| 5,228,427 | A | 7/1993 | Gardner |
| 5,237,773 | A | 8/1993 | Claridge |
| 5,241,146 | A | 8/1993 | Priesemuth |
| 5,272,514 | A | 12/1993 | Dor |
| 5,299,375 | A | 4/1994 | Thummel et al. |
| 5,343,376 | A | 8/1994 | Huang |
| 5,355,608 | A | 10/1994 | Teetzel |
| 5,355,609 | A | 10/1994 | Schenke |
| 5,365,669 | A | 11/1994 | Rustick et al. |
| 5,367,779 | A | 11/1994 | Lee |
| 5,373,644 | A | 12/1994 | De Paoli |
| 5,375,362 | A | 12/1994 | McGarry et al. |
| 5,388,335 | A | 2/1995 | Jung |
| 5,392,550 | A | 2/1995 | Moore et al. |
| 5,400,540 | A | 3/1995 | Solinsky et al. |
| 5,419,072 | A | 5/1995 | Moore et al. |
| 5,432,598 | A | 7/1995 | Szatkowski |
| 5,435,091 | A | 7/1995 | Toole et al. |
| 5,446,535 | A | 8/1995 | Williams |
| 5,448,834 | A | 9/1995 | Huang |
| 5,454,168 | A | 10/1995 | Langner |
| 5,455,397 | A | 10/1995 | Havenhill et al. |
| 5,467,552 | A | 11/1995 | Cupp et al. |
| 5,481,819 | A | 1/1996 | Teetzel |
| 5,488,795 | A | 2/1996 | Sweat |
| D368,121 | S | 3/1996 | Lam |
| 5,499,455 | A | 3/1996 | Palmer |
| 5,509,226 | A | 4/1996 | Houde-Walter |
| 5,515,636 | A | 5/1996 | McGarry et al. |
| 5,531,040 | A | 7/1996 | Moore |
| 5,555,662 | A | 9/1996 | Teetzel |
| 5,557,872 | A | 9/1996 | Langner |
| 5,566,459 | A | 10/1996 | Breda |
| 5,581,898 | A | 12/1996 | Thummel |
| 5,584,137 | A | 12/1996 | Teetzel |
| 5,590,486 | A | 1/1997 | Moore |
| 5,598,958 | A | 2/1997 | Ryan, III et al. |
| 5,618,099 | A | 4/1997 | Brubacher |
| 5,621,999 | A | 4/1997 | Moore |
| 5,622,000 | A | 4/1997 | Marlowe |
| 5,669,174 | A | 9/1997 | Teetzel |
| 5,671,561 | A | 9/1997 | Johnson et al. |
| 5,685,106 | A | 11/1997 | Shoham |
| 5,685,636 | A | 11/1997 | German |
| 5,694,202 | A | 12/1997 | Mladjan et al. |
| 5,694,713 | A | 12/1997 | Paldino |
| 5,704,153 | A | 1/1998 | Kaminski et al. |
| 5,706,600 | A | 1/1998 | Toole et al. |
| 5,716,216 | A | 2/1998 | O'Loughlin |
| 5,735,070 | A | 4/1998 | Vasquez et al. |
| 5,787,631 | A | 8/1998 | Kendall |
| 5,788,500 | A | 8/1998 | Gerber |
| 5,822,905 | A | 10/1998 | Teetzel |
| 5,842,300 | A | 12/1998 | Cheshelski et al. |
| 5,847,345 | A | 12/1998 | Harrison |
| 5,867,930 | A | 2/1999 | Kaminski et al. |
| 5,881,707 | A | 3/1999 | Gardner |
| 5,892,221 | A | 4/1999 | Lev |
| 5,896,691 | A | 4/1999 | Kaminski et al. |
| 5,905,238 | A | 5/1999 | Hung |
| 5,909,951 | A | 6/1999 | Johnsen et al. |
| 5,922,030 | A | 7/1999 | Shank et al. |
| 5,967,133 | A | 10/1999 | Gardner |
| 5,983,774 | A | 11/1999 | Mihaita |
| 6,003,504 | A | 12/1999 | Rice et al. |
| 6,023,875 | A | 2/2000 | Fell et al. |
| 6,035,843 | A | 3/2000 | Smith et al. |
| 6,146,141 | A | 11/2000 | Schumann |
| 6,151,788 | A | 11/2000 | Cox et al. |
| 6,219,952 | B1 | 4/2001 | Mossberg et al. |
| 6,230,431 | B1 | 5/2001 | Bear |
| 6,237,271 | B1 | 5/2001 | Kaminski |
| 6,282,829 | B1 | 9/2001 | Mossberg et al. |
| 6,289,624 | B1 | 9/2001 | Hughes et al. |
| 6,293,869 | B1 | 9/2001 | Kwan |
| 6,295,753 | B1 | 10/2001 | Thummel |
| 6,301,046 | B1 | 10/2001 | Tai et al. |
| 6,318,228 | B1 | 11/2001 | Thompson |
| 6,327,806 | B1 | 12/2001 | Paige |
| 6,345,464 | B1 | 2/2002 | Kim et al. |
| 6,363,648 | B1 | 4/2002 | Kranich et al. |
| 6,366,349 | B1 | 4/2002 | Houde-Walter |
| 6,371,004 | B1 | 4/2002 | Peterson |
| 6,385,893 | B1 | 5/2002 | Cheng |
| 6,389,729 | B2 | 5/2002 | Rauch et al. |
| 6,389,730 | B1 | 5/2002 | Millard |
| 6,397,509 | B1 | 6/2002 | Langner |
| 6,430,861 | B1 | 8/2002 | Ayers et al. |

(56) References Cited

U.S. PATENT DOCUMENTS

| | | | |
|---|---|---|---|
| 6,434,874 | B1 | 8/2002 | Hines |
| 6,442,880 | B1 | 9/2002 | Allan |
| 6,487,807 | B1 | 12/2002 | Kopman et al. |
| 6,499,247 | B1 | 12/2002 | Peterson |
| 6,526,688 | B1 | 3/2003 | Danielson et al. |
| 6,568,118 | B1 | 5/2003 | Teetzel |
| 6,572,375 | B2 | 6/2003 | Shechter et al. |
| 6,575,753 | B2 | 6/2003 | Rosa et al. |
| 6,578,311 | B2 | 6/2003 | Danielson et al. |
| 6,579,098 | B2 | 6/2003 | Shechter |
| 6,591,536 | B2 | 7/2003 | Houde-Walter et al. |
| 6,606,797 | B1 | 8/2003 | Gandy |
| 6,616,452 | B2 | 9/2003 | Clark et al. |
| 6,622,414 | B1 | 9/2003 | Oliver et al. |
| 6,631,580 | B2 | 10/2003 | Iafrate |
| 6,631,668 | B1 | 10/2003 | Wilson et al. |
| 6,650,669 | B1 | 11/2003 | Adkins |
| 6,671,991 | B1 | 1/2004 | Danielson |
| D487,791 | S | 3/2004 | Freed |
| 6,742,299 | B2 | 6/2004 | Strand |
| 6,782,789 | B2 | 8/2004 | McNulty |
| 6,843,478 | B1 | 1/2005 | Hoepelman |
| 6,854,205 | B2 | 2/2005 | Wikle et al. |
| 6,931,775 | B2 | 8/2005 | Burnett |
| 6,935,864 | B2 | 8/2005 | Shechter et al. |
| 6,945,782 | B2 | 9/2005 | Isoz |
| 6,966,775 | B1 | 11/2005 | Kendir et al. |
| 7,032,342 | B2 | 4/2006 | Pikielny |
| 7,049,575 | B2 | 5/2006 | Hotelling |
| 7,111,424 | B1 | 9/2006 | Moody et al. |
| 7,121,034 | B2 | 10/2006 | Keng |
| 7,134,234 | B1 | 11/2006 | Makarounis |
| 7,191,557 | B2 | 3/2007 | Gablowski et al. |
| D542,446 | S | 5/2007 | DiCarlo et al. |
| 7,218,501 | B2 | 5/2007 | Keely |
| 7,237,352 | B2 | 7/2007 | Keely et al. |
| 7,243,454 | B1 | 7/2007 | Cahill |
| 7,260,910 | B2 | 8/2007 | Danielson |
| 7,264,369 | B1 | 9/2007 | Howe |
| 7,303,306 | B2 | 12/2007 | Ross et al. |
| 7,305,790 | B2 | 12/2007 | Kay |
| 7,329,127 | B2 | 2/2008 | Kendir et al. |
| 7,331,137 | B2 | 2/2008 | Hsu |
| D567,894 | S | 4/2008 | Sterling et al. |
| 7,360,333 | B2 | 4/2008 | Kim |
| D570,948 | S | 6/2008 | Cerovic et al. |
| RE40,429 | E | 7/2008 | Oliver et al. |
| D578,599 | S | 10/2008 | Cheng |
| 7,441,364 | B2 | 10/2008 | Rogers et al. |
| 7,453,918 | B2 | 11/2008 | Laughman et al. |
| 7,454,858 | B2 | 11/2008 | Griffin |
| 7,464,495 | B2 | 12/2008 | Cahill |
| 7,472,830 | B2 | 1/2009 | Danielson |
| D586,874 | S | 2/2009 | Moody et al. |
| 7,490,429 | B2 | 2/2009 | Moody et al. |
| 7,578,089 | B1 | 8/2009 | Griffin |
| 7,584,569 | B2 | 9/2009 | Kallio |
| 7,591,098 | B2 | 9/2009 | Matthews et al. |
| D602,109 | S | 10/2009 | Cerovic et al. |
| 7,603,997 | B2 | 10/2009 | Hensel et al. |
| D603,478 | S | 11/2009 | Hughes |
| 7,624,528 | B1 | 12/2009 | Bell et al. |
| 7,627,976 | B1 | 12/2009 | Olson |
| 7,644,530 | B2 | 1/2010 | Scherpf |
| 7,652,216 | B2 | 1/2010 | Sharrah et al. |
| D612,756 | S | 3/2010 | D'Amelio et al. |
| D612,757 | S | 3/2010 | D'Amelio et al. |
| 7,674,003 | B2 | 3/2010 | Sharrah et al. |
| 7,676,975 | B2 | 3/2010 | Phillips et al. |
| 7,685,756 | B2 | 3/2010 | Moody et al. |
| 7,698,847 | B2 | 4/2010 | Griffin |
| 7,703,719 | B1 | 4/2010 | Bell et al. |
| 7,712,241 | B2 | 5/2010 | Teetzel et al. |
| D616,957 | S | 6/2010 | Rievley et al. |
| 7,726,059 | B2 | 6/2010 | Pikielny |
| 7,726,061 | B1 | 6/2010 | Thummel |
| 7,730,820 | B2 | 6/2010 | Vice et al. |
| 7,743,546 | B2 | 6/2010 | Keng |
| 7,743,547 | B2 | 6/2010 | Houde-Walter |
| 7,753,549 | B2 | 7/2010 | Solinsky et al. |
| 7,771,077 | B2 | 8/2010 | Miller |
| 7,797,843 | B1 | 9/2010 | Scott et al. |
| 7,805,876 | B1 | 10/2010 | Danielson et al. |
| 7,818,910 | B2 | 10/2010 | Young |
| 7,827,726 | B2 | 11/2010 | Stokes |
| 7,841,120 | B2 | 11/2010 | Teetzel et al. |
| 7,880,100 | B2 | 2/2011 | Sharrah et al. |
| 7,900,390 | B2 | 3/2011 | Moody et al. |
| 7,913,439 | B2 | 3/2011 | Whaley |
| D636,049 | S | 4/2011 | Hughes et al. |
| D636,837 | S | 4/2011 | Hughes et al. |
| 7,921,591 | B1 | 4/2011 | Adcock |
| 7,926,218 | B2 | 4/2011 | Matthews et al. |
| 7,997,023 | B2 | 8/2011 | Moore et al. |
| 8,001,715 | B2 | 8/2011 | Stokes |
| 8,006,427 | B2 | 8/2011 | Blevins et al. |
| 8,006,428 | B2 | 8/2011 | Moore et al. |
| 8,028,460 | B2 | 10/2011 | Williams |
| 8,028,461 | B2 | 10/2011 | NuDyke |
| 8,050,307 | B2 | 11/2011 | Day et al. |
| 8,056,277 | B2 | 11/2011 | Griffin |
| 8,093,992 | B2 | 1/2012 | Jancie et al. |
| 8,104,220 | B2 | 1/2012 | Cobb |
| D653,798 | S | 2/2012 | Janice et al. |
| 8,109,024 | B2 | 2/2012 | Abst |
| 8,110,760 | B2 | 2/2012 | Sharrah et al. |
| 8,132,354 | B1 | 3/2012 | Sellers et al. |
| 8,136,284 | B2 | 3/2012 | Moody et al. |
| 8,141,288 | B2 | 3/2012 | Dodd et al. |
| 8,146,282 | B2 | 4/2012 | Cabahug et al. |
| 8,151,504 | B1 | 4/2012 | Aiston |
| 8,151,505 | B2 | 4/2012 | Thompson |
| 8,166,694 | B2 | 5/2012 | Swan |
| 8,172,139 | B1 | 5/2012 | McDonald et al. |
| D661,366 | S | 6/2012 | Zusman |
| 8,196,328 | B2 | 6/2012 | Simpkins |
| 8,215,047 | B2 | 7/2012 | Ash et al. |
| 8,225,542 | B2 | 7/2012 | Houde-Walter |
| 8,225,543 | B2 | 7/2012 | Moody et al. |
| 8,245,428 | B2 | 8/2012 | Griffin |
| 8,245,434 | B2 | 8/2012 | Hogg et al. |
| 8,256,154 | B2 | 9/2012 | Danielson et al. |
| 8,258,416 | B2 | 9/2012 | Sharrah et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |
| D669,959 | S | 10/2012 | Johnston et al. |
| D670,785 | S | 11/2012 | Fitzpatrick et al. |
| 8,312,666 | B2 | 11/2012 | Moore et al. |
| D672,005 | S | 12/2012 | Hedeen et al. |
| 8,322,064 | B2 | 12/2012 | Cabahug et al. |
| 8,335,413 | B2 | 12/2012 | Dromaretsky et al. |
| D674,861 | S | 1/2013 | Johnston et al. |
| D674,862 | S | 1/2013 | Johnston et al. |
| D675,281 | S | 1/2013 | Speroni |
| 8,341,868 | B2 | 1/2013 | Zusman |
| 8,347,541 | B1 | 1/2013 | Thompson |
| 8,356,818 | B2 | 1/2013 | Mraz |
| 8,360,598 | B2 | 1/2013 | Sharrah et al. |
| D676,097 | S | 2/2013 | Izumi |
| 8,365,456 | B1 | 2/2013 | Shepard |
| D677,433 | S | 3/2013 | Swan et al. |
| D678,976 | S | 3/2013 | Pittman |
| 8,387,294 | B2 | 3/2013 | Bolden |
| 8,393,104 | B1 | 3/2013 | Moody et al. |
| 8,393,105 | B1 | 3/2013 | Thummel |
| 8,397,418 | B2 | 3/2013 | Cabahug et al. |
| 8,402,683 | B2 | 3/2013 | Cabahug et al. |
| 8,413,362 | B2 | 4/2013 | Houde-Walter |
| D682,977 | S | 5/2013 | Thummel et al. |
| 8,443,539 | B2 | 5/2013 | Cabahug et al. |
| 8,444,291 | B2 | 5/2013 | Swan et al. |
| 8,448,368 | B2 | 5/2013 | Cabahug et al. |

(56) References Cited

U.S. PATENT DOCUMENTS 8,458,944 B2 6/2013 Houde-Walter
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 * 11/2013 Uhr ..... F41G 3/2655 102/444
8,607,495 B2 12/2013 Moore et al.
D697,162 S 1/2014 Faifer
8,661,725 B1 3/2014 Ganther et al.
8,662,694 B1 * 3/2014 Izumi ..... F41G 1/34 362/109
8,734,156 B2 * 5/2014 Uhr ..... 434/19
8,739,447 B2 6/2014 Merritt et al.
8,807,779 B1 8/2014 Izumi et al.
8,813,411 B2 8/2014 Moore et al.
8,844,189 B2 9/2014 Moore et al.
8,919,023 B2 12/2014 Merritt et al.
8,938,904 B1 1/2015 Sellers et al.
8,944,838 B2 2/2015 Mulfinger
9,146,077 B2 9/2015 Moore
9,182,194 B2 * 11/2015 Moore ..... F41C 23/16
9,188,407 B2 11/2015 Moore
9,297,614 B2 3/2016 Moore
9,644,826 B2 5/2017 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0129536 A1 9/2002 Iafrate et al.
2002/0134000 A1 9/2002 Varshneya et al.
2002/0194767 A1 12/2002 Houde-Walter et al.
2003/0003424 A1 1/2003 Shechter et al.
2003/0029072 A1 2/2003 Danielson
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2005/0044736 A1 3/2005 Liao
2005/0130739 A1 * 6/2005 Argentar ..... A63F 13/02 463/36
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 * 2/2007 Stokes ..... F41C 23/16 42/146
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0229448 A1 9/2010 Houde-Walter
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0162249 A1 7/2011 Woodmansee et al.
2011/0185619 A1 8/2011 Finnegan et al.
2012/0005938 A1 1/2012 Sloan
2012/0047787 A1 3/2012 Curry
2012/0055061 A1 3/2012 Hartley et al.
2012/0110886 A1 5/2012 Moore et al.
2012/0124885 A1 5/2012 Caulk et al.
2012/0144716 A1 * 6/2012 Cabahug ..... F41C 23/22 42/84
2012/0180366 A1 7/2012 Jaroh et al.
2012/0180367 A1 7/2012 Singh
2012/0180370 A1 7/2012 McKinley
2012/0224357 A1 9/2012 Moore
2013/0185978 A1 * 7/2013 Dodd ..... F41C 23/22 42/84
2013/0185982 A1 7/2013 Hilbourne et al.
2013/0263492 A1 10/2013 Erdle
2014/0007485 A1 * 1/2014 Castejon, Sr. ..... F41G 1/35 42/117
2014/0109457 A1 4/2014 Speroni
2014/0355258 A1 12/2014 Izumi et al.
2015/0283459 A1 10/2015 Condon
2015/0308670 A1 10/2015 Moore
2015/0345905 A1 12/2015 Hancosky
2015/0348330 A1 12/2015 Balachandreswaran
2016/0059136 A1 3/2016 Ferris
2016/0084618 A1 3/2016 Hong
2016/0091285 A1 3/2016 Mason
2016/0161220 A1 6/2016 Moore
2016/0305748 A1 10/2016 Moore
2016/0361626 A1 12/2016 Moore
2017/0003103 A1 1/2017 Moore
2017/0082399 A1 3/2017 Moore
2017/0153095 A1 6/2017 Moore
2017/0160054 A1 6/2017 Moore

OTHER PUBLICATIONS

EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 09169469.
EPO; Search Opinion and Report dated Aug. 23, 2010 in Serial. No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.

(56) References Cited

OTHER PUBLICATIONS

USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
USPTO; Notice of Allowance dated Nov. 15, 2016 in U.S. Appl. No. 14/630,467.
USPTO; Non-Final Office Action dated Aug. 30, 2016 in U.S. Appl. No. 14/955,440.
UPSTO; Non-Final Office Action dated Oct. 6, 2016 in U.S. Appl. No. 15/243,813.
USPTO; Office Action dated Feb. 24, 2017 in U.S. Appl. No. 15/166,145.
USPTO; Notice of Allowance dated Mar. 7, 2017 in U.S. Appl. No. 14/630,467.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.

(56) References Cited

OTHER PUBLICATIONS

Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Final Office Action dated May 18, 2017 in U.S. Appl. No. 15/243,813.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.

* cited by examiner

FRONT-GRIP LIGHTING DEVICE

CROSS REFERENCE TO RELATED APPLICATION

This application is a continuation of and claims priority to U.S. application Ser. No. 14/793,016 entitled "FRONT-GRIP LIGHTING DEVICE", filed on Jul. 7, 2015, which is a continuation of U.S. application Ser. No. 14/182,140 entitled "FRONT-GRIP LIGHTING DEVICE", filed on Feb. 17, 2014, the contents of each are incorporated herein in their entirety for all purposes.

FIELD OF THE INVENTION

The present invention is generally directed to a lighting device for a firearm that is positioned in a front grip of the firearm.

BACKGROUND OF THE INVENTION

Vertical fore grips have become popular with firearms, such as rifles and machine pistols. A fore grip provides the operator with a front handle to both support and help aim the firearm. Fore grips usually include an elongated handle that can be gripped by the hand not operating the trigger. Often, the fore grip is removable and attached to the firearm by a bracket that attaches to a rail (such as a picatinny rail) underneath the firearm.

In addition to elongated handles, vertical fore grips have included other variations such as bipods or tripods to support the firearm while firing it.

Often the rail type brackets underneath the firearm are used to support accessories such as lights. However, using a removable fore grip takes away the space that has been used for the accessory lights. Thus, operators often have to choose whether to use the removable fore grips on the bottom facing rails or use accessory lights. To generally solve this problem it has been known to attach lights to vertically-extending fore grips, but the operation of same has been limited.

The disclosures of U.S. Pat. No. 8,127,485 entitled "GUN WITH MOUNTED SIGHTING DEVICE" to Moore et al., U.S. Pat. No. 8,312,665 entitled "SIDE-MOUNTED LIGHTING DEVICE" to Moore et al. and U.S. patent application Ser. No. 13/707,312 entitled "SIGHTING DEVICE REPLICATING SHOTGUN PATTERN SPREAD" to Moore et al. are incorporated herein by reference.

SUMMARY OF THE INVENTION

The present invention relates to a fore grip that can be attached to or integrally formed with a firearm and that includes a light source and a power source housed within the fore grip. The fore grip preferably has a portion generally parallel to the gun barrel and a downward-angled portion, rather than just extending vertically downward from the gun barrel. The light source preferably is a laser and has at least three operating conditions: a first condition wherein the light source is constantly on, a second condition wherein the light source is constantly off, and a third condition wherein the light source is turned on by a second switch. A first switch is moveable between three positions, wherein each of the positions corresponds to one of the three operating conditions. At least one second switch is provided that can be activated in any suitable manner (such as by pressing the second switch). To use the light source, the user moves the first switch to either the first position wherein the light source is constantly on or the third position in which the light source is activated when the second switch is activated. In one embodiment, there are two second switches, one on each side of the fore grip, so that a user can press either of the second switches to activate the light source when the first switch is in the third position.

DETAILED DESCRIPTION OF PREFERRED EMBODIMENTS

Figure 1:
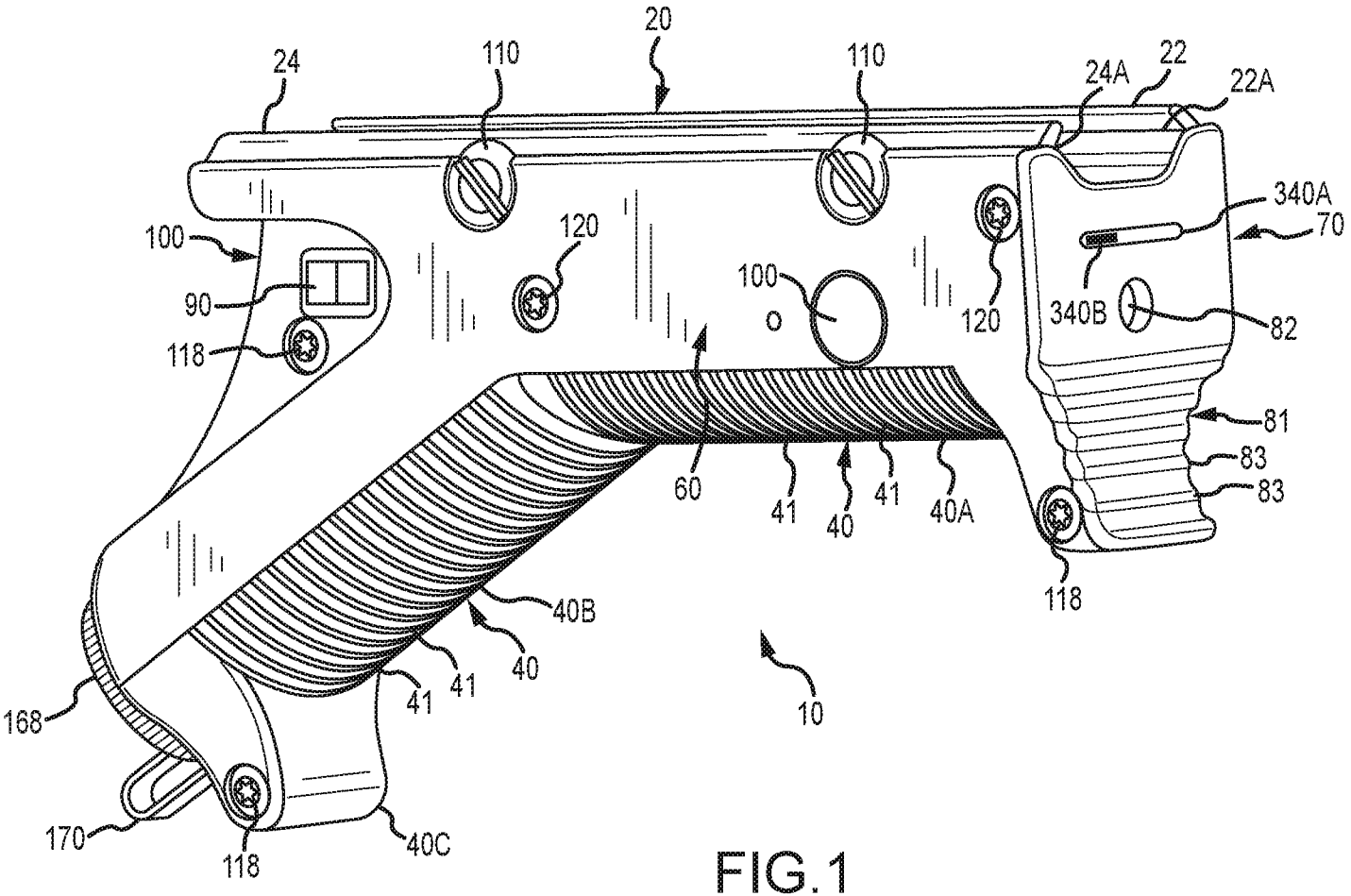
FIG. 1 is a side, perspective view of a fore grip according to aspects of the invention.

Turning now to the drawings, where the purpose is to describe preferred embodiments of the invention and not to limit same, FIG. 1 shows a fore grip 10 according to aspects of the invention. Fore grip 10 has a top portion 20, a bottom portion 40, two side portions 60 and 70, a front portion 80 and rear portion 100. Top portion 20 in this embodiment is designed to fit on the picatinny rail of a firearm, although any suitable method of attachment may be used. Top portion 20 has a first rail 22 and a second rail 24 opposite first rail 22. A groove 22A is at the base of first rail 22 and a groove 24A is at the base of second rail 24. The grooves 22A and 24A oppose one another, and the picatinny rail (not shown) of a firearm is received between the two. Bottom portion 40 as shown has a first portion 40A, which is preferably substantially parallel with the gun barrel when fore grip 10 is mounted on a fire arm, a second portion 40B, which is preferably formed at an angle of about 20° to 45°, and most preferably about 30°, to portion 40A, and a third portion 40C that extends downward and outward at either a vertical or 10°-45° angle away from portion 40B to create support for, and an easy way to properly position on the fore grip, a user's hand.

Fore grip 10 also includes a front grip (or fourth) portion 81 that extends downward from the front of portion 40A and provides an additional gripping surface. Front grip portion 81 may include ridges 83 to facilitate a better grip.

As shown, each of sections 40A and 40B include grooves 41 that assist a user in gripping the fore grip 10 and any suitable structure or surface texturing may be used for this purpose.

Bolts 110 pass through apertures 112 of side 60 and 114 of side 70 and are threaded into nuts 116. In this manner, bolts 110 and nuts 116 tighten grooves 22A and 24A against the picatinny rail of a firearm, although any suitable method or structure for affixing fore grip 10 to a firearm may be used.

To attach casing sides 60 and 70, fasteners 118 and 120 are utilized and pass through apertures in side 60 to be received in bosses 119 (which receive fasteners 118) and bosses 121 (which receive fasteners 120).

Figure 3:
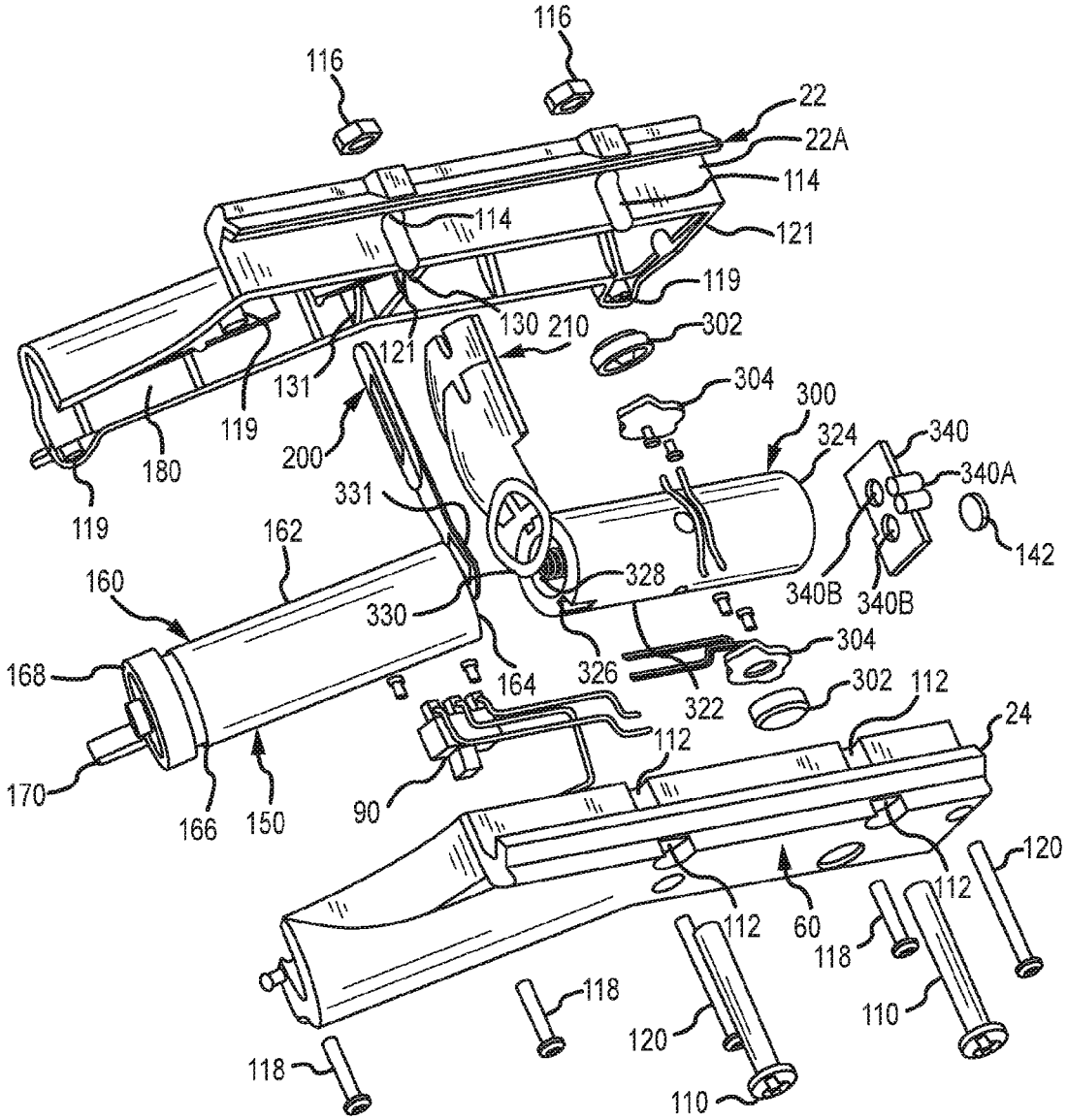
FIG. 3 is an exploded view of the fore grip according to FIG. 1.

A first switch 90 is in communication with the battery module printed circuit board (or PCB) 200 and the laser module PCB 210, each of which are best seen in FIG. 3. In this embodiment the first switch has three positions wherein each position alters the functioning of the battery module PCB 200 and the laser module PCB 210 to enable the laser module 300 to function in one of three ways: (1) continuously off; (2) continuously on; or (3) on only when one of the second switches is pressed. When activated to be on, the laser may pulse to save power, such as by rapidly pulsing off and on at about 500-2000, or about 1000 times per second, at about a 50% duty cycle, although any suitable pulse rate and duty cycle may be used to save power while still providing a laser light beam adequate to sight a target.

One or more second switches 100 can be located at any suitable position on fore grip 10. The purpose of second switch(es) 100 is to communicate with the laser module PCB 210 and activate the laser module 300 when power is available to module 300 because first switch 90 is in its third position. Most preferably switch(es) 100 are momentary switches that are pressed by a user's finger. In the embodiment shown there is a switch 100 on either side, 60 and 70, of fore grip 10. Preferably, switches 100 function so that the laser module 300 is activated if either of switches 100 are pressed. Alternatively, the laser module 300 can be activated only when both second switches 100 are pressed simultaneously (such as simultaneously by the thumb and forefinger of one hand). That manner of operation helps prevent a user from accidentally activating the laser module 300. Further, any of the one or more second switch(es) 100 may be another type of switch, such as a slide switch.

Figure 2:
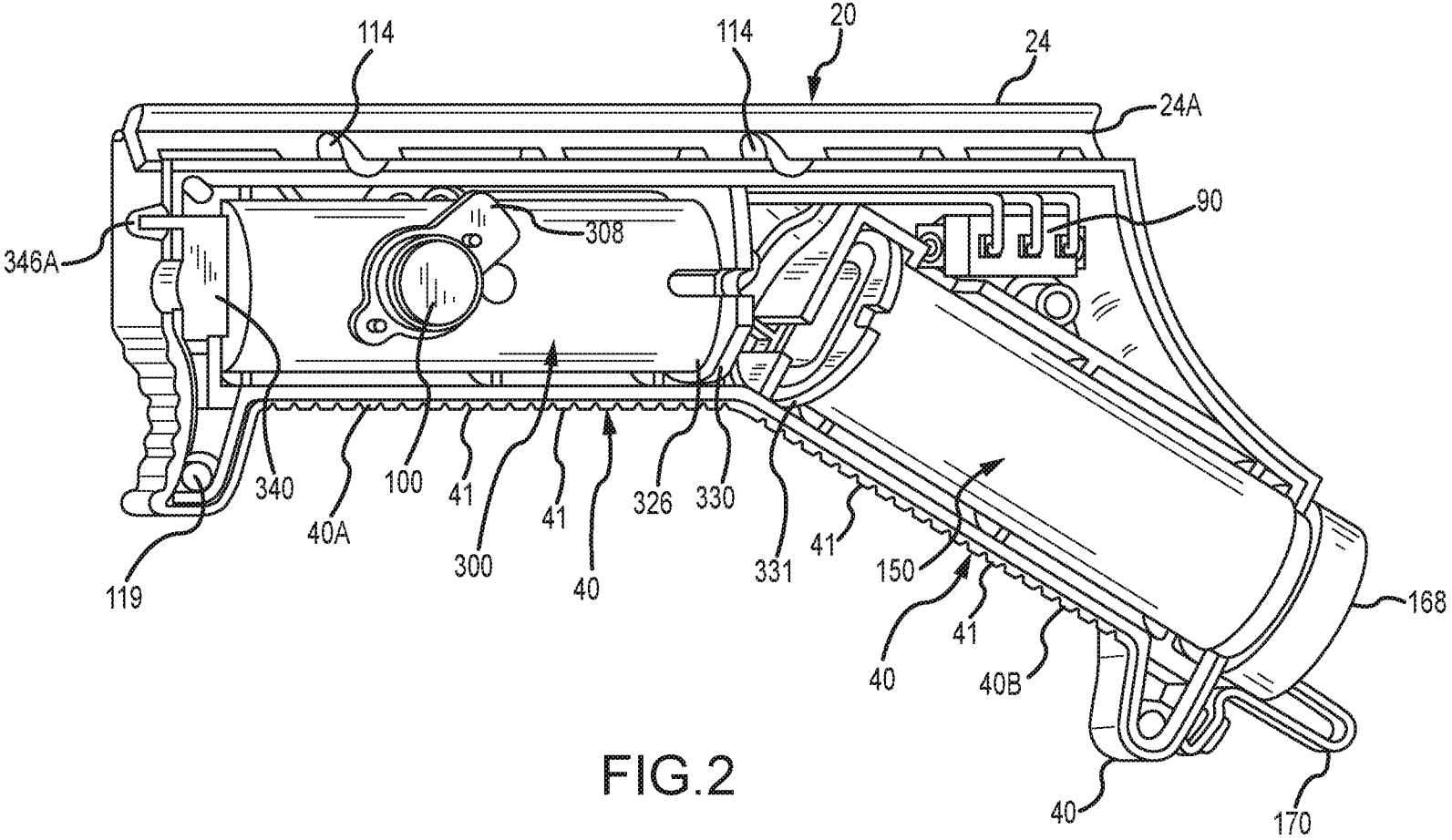
FIG. 2 is a side view of the fore grip according to FIG. 1 with the side of the casing removed to expose the inside.

Second switch(es) 100 are preferably mounted on either side of laser module 300 and include a switch button 302 and a switch board 304, wherein a pad (not shown) is mounted on switch board 304 and is in communication with module 300. As shown best in FIG. 2, wires 308 connect each switch 100 to laser module PCB 210.

Laser module 300 comprises an outer housing 320 that protects an internal laser module (not shown). Outer housing 320 has an annular outer surface 322, a first end 324 having an opening (not shown) through which laser light can pass, and a second end 326 that exposes a spring 328 or other biasing device that is connected to the laser module and (in this embodiment) provides a negative electrical contact. A wave washer 330 is between second end 328 and an internal wall 130 adjacent one of the bosses 121 to pressure fit laser module 300 into place and against laser module PCB 200. A lens (not shown) is at the end of the internal laser module and laser light is projected thorough the lens when the module 300 is activated. The laser light passes through an opening 82 is the front surface 80 of fore grip 10.

As shown, positioned inside of fore grip 10 between first end 324 of laser module 300 and aperture 82 is a laser lens slide 340. Slide 340 is manually moved by a user between a first position wherein the laser light passes through an opening 340B and a second position wherein the laser light passes through another opening 340B. A user moves slide 340 by manually manipulating projection 340A, which extends outward from slot opening 350.

In this embodiment opening 340A had no lens and laser light passing through opening 340A is in a straight beam without interruption. Opening 340B includes a lens 142 that alters the laser light existing the internal laser module, such as to create a pattern of light, such as a cross hair, vertical beam, horizontal beam, circular pattern of light beams, or circular pattern of light beams with a light beam in the center of the circumference of the circular pattern. Alternatively, there need not be a lens slide or the lens slide may have one or more different types of lenses than the ones described herein.

Power module 150 has an outer housing 160 that receives one or more batteries (not shown), which is preferably one 3V lithium photo cell battery, but could be any suitable battery(ies) or power source, and is preferably a 3V power source. Outer housing 160 has an annular outer surface 162, a first end 164 and a second end 166. A cap 168 is removalby attached to second end 166 preferably by being threadingly received, and is attached to the outer-casing of fore grip 10 by strap 170. Cap 168 can be removed to remove and/or add batteries to power module 150. Cap 168 and strap 170 are preferably comprised of any suitable plastic while modules 150 and 300 are preferably comprised of aluminum. Power module 150 fits in cavity 180 and is pressure fit against wave washer 331, which presses against wall 131 and biases module 150 towards power module PCB 210 and provides a negative contact.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A fore grip of a firearm, the fore grip comprising:

(a) a light source;

(b) a power source physically separated from and behind the light source, wherein the power source provides power for activating the light source;

(c) a first PCB in electrical communication with a first switch and the power source;

(d) a second PCB in electrical communication with the first PCB and the light source; and (e) a first switch to activate the power source, wherein the first switch has a first position wherein the light source is constantly off, a second position wherein the light source is constantly on, and a third position wherein the light source is on when a second switch is activated.

2. The fore grip of claim 1 wherein the light source is a laser module.

3. The fore grip of claim 1 wherein the fore grip has a first section that is attached to a gun and the light source is positioned inside of the first section.

4. The fore grip of claim 3 wherein the light source is positioned in a first cavity of the fore grip.

5. The fore grip of claim 1 wherein fore grip has a second section that extends downward at an angle from the first section and the power source is positioned in the second section.

6. The fore grip of claim 5 wherein the power source is positioned in a second cavity of the fore grip.

7. The fore grip of claim 1 wherein the power source is one or more batteries.

8. The fore grip of claim 1 wherein the second switch is mounted on the light source.

9. The fore grip of claim 2 wherein the second switch is mounted on the laser module.

10. The fore grip of claim 1 that includes a plurality of second switches and when the first switch is in its third position the light source can be activated by activating any of the plurality of second switches.

11. The fore grip of claim 1 that includes two second switches that are activated simultaneously to activate the light source when the first switch is in its third position.

12. The fore grip of claim 1 wherein the first switch is a slide switch.

13. The fore grip of claim 1 wherein the second switch is a momentary switch.

14. The fore grip of claim 11 wherein both second switches are momentary switches.

15. The fore grip of claim 1 that has an outer housing having a first half connected to a second half.

16. The fore grip of claim 1 wherein the first PCB and second PCB are physically separated.

17. The fore grip of claim 1 that has an attachment portion configured to attach to the picatinny rail of a firearm.

18. The fore grip of claim 2 wherein the laser module has a first end though which laser light is emitted, and further includes a lens slide juxtaposed the first end wherein the lens slide includes a plurality of openings and at least one opening includes a lens that modifies the travel of laser light passing through it, the slide movable to at least one position at which laser light emitted from the first end of the laser module passes through one of the plurality of openings.

19. The fore grip of claim 18 wherein at least one lens in the lens slide modifies the laser light emitted from the laser module into a circular pattern of individual laser light beams.

20. The fore grip of claim 1 that includes a plurality of second switches wherein when the first switch is in its third position the light source can be activated by activating any of the plurality of second switches.

* * * * *